United States Patent [19]

Hamilton et al.

[11] Patent Number: 4,774,861

[45] Date of Patent: Oct. 4, 1988

[54] DRILL PIPE SPINNER

[75] Inventors: William R. Hamilton, Houston; Harry D. Hebard, Burnet, both of Tex.

[73] Assignee: Hughes Tool Company, Houston, Tex.

[21] Appl. No.: 117,272

[22] Filed: Nov. 5, 1987

[51] Int. Cl.[4] ..... B25B 13/50

[52] U.S. Cl. ..... 81/57.33; 81/57.19; 81/57.2

[58] Field of Search ..... 81/57.16, 57.15, 57.18, 81/57.19, 57.2, 57.33–57.35

[56] References Cited

U.S. PATENT DOCUMENTS

| | | | |
|---|---|---|---|
| 3,027,155 | 3/1962 | Paterson | 269/32 |
| 3,170,322 | 2/1965 | Cavanaugh | 73/103 |
| 3,892,148 | 7/1975 | Wiley | 81/57.18 |
| 4,402,239 | 9/1983 | Mooney | 81/57.16 |
| 4,474,088 | 10/1984 | Lee | 81/57.18 |

*Primary Examiner*—Debra Meislin

*Attorney, Agent, or Firm*—H. Dennis Kelly

[57] ABSTRACT

A drill pipe spinner having a body with an open throat for receiving a drill pipe. A pair of cylindrical driven rollers are mounted on the body for rotation about a vertical axis. A pair of pressure arms are pivotally mounted on the body for rotation about a primary pivot pin. A pair of secondary pressure arms are mounted on the primary pressure arms, for rotation relative to the primary pressure arm about a secondary pivot pin. A pair of cylindrical pressure rollers are mounted on the secondary pressure arms, for holding the drill pipe against the driven roller. A pair of piston and cylinder assemblies exert force on the secondary pressure arms, to cause the secondary pressure arms to rotate. The moment arms between the piston and cylinder assemblies and the primary pivot pins are shorter than the moment arms between the piston and cylinder assemblies and the secondary pivot pins. Springs, mounted between the primary and secondary pressure arms, cause the primary pressure arms to rotate with the secondary pressure arms, about the primary pivot pins, until the pressure rollers have contacted the drill pipe. A plurality of sprag clutches prevent back rotation of the primary pressure arms about the primary pivot pins.

6 Claims, 2 Drawing Sheets

DRILL PIPE SPINNER

BACKGROUND OF THE INVENTION

1. Field of the Invention

This invention relates in general to the field of oil well drilling rig equipment. In particular, the invention relates to power equipment for spinning drill pipe.

2. Description of the Prior Art

During the making up or breaking out of joints between stands of drill pipe, one stand is held stationary by a back-up tong, while the other stand is rotated. A torque wrench is used for final make-up and for initial break-out. During initial make-up or final break-out, a different tool is used to spin the drill pipe at a high speed.

The cheapest way to spin drill pipe is with a spinning chain. However, spinning chains are dangerous and are not as effective on heavier pipe and drill collars.

Hydraulically powered drill pipe spinners were developed to replace spinning chains. Power drill pipe spinners typically have two pairs of opposed rollers. One roller of each pair is power driven, and the other applies pressure to the drill pipe to keep the pipe against the driven rollers.

The pressure rollers are typically pivotable, to allow entry of the drill pipe into the body of the spinner. One method of pivoting the pressure rollers is to mount the pressure rollers on pressure arms, which are pivotable about one or two pivot pins. One or two hydraulic cylinders are used to apply force to the pressure arms.

It is desirable to multiply the force of the cylinders, particularly after the pressure rollers contact the drill pipe. Force multiplication allows a smaller hydraulic cylinder to maintain sufficient pressure on the drill pipe to avoid slippage.

SUMMARY OF THE INVENTION

The power drill pipe spinner of the invention multiplies the force of the cylinders. The factor by which the force is multiplied is increased after the pressure rollers contact the drill pipe. This increase is accomplished by increasing the moment arm when the pressure rollers contact the drill pipe.

The pressure rollers are mounted on secondary pressure arms. A pair of hydraulic cylinders exert force on the other end of the secondary pressure arms.

The secondary pressure arms are mounted on primary pressure arms, which are mounted on the body of the spinner. Springs keep the pressure arms from rotating relative to one another prior to contacting the drill pipe.

A series of sprag clutches prevents back rotation of the primary pressure arms. When the pressure rollers contact the drill pipe, the moment arms shift from the primary pivot pins to the secondary pivot pins. Since the new moment arms are longer than the original moment arms, the force of the pressure rollers on the drill pipe is increased.

DESCRIPTION OF THE PREFERRED EMBODIMENT

Figure 1:
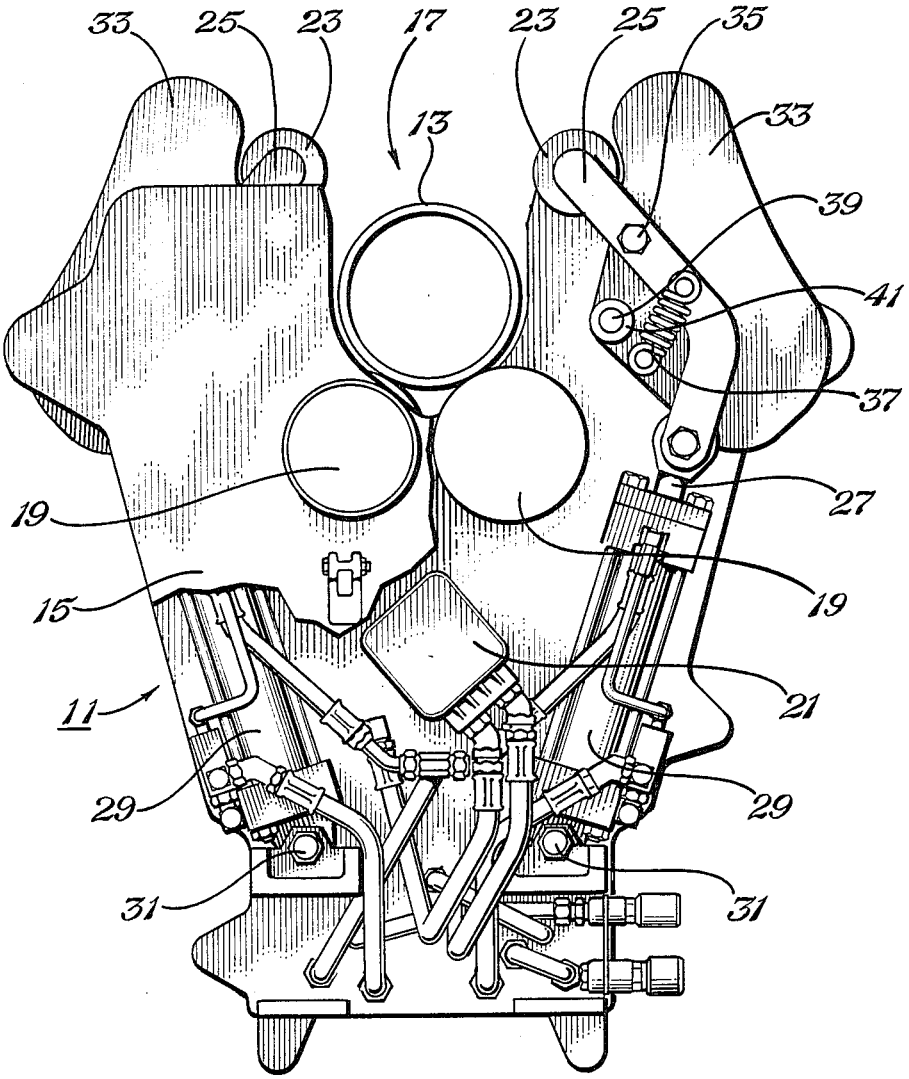
FIG. 1 is a top view, partially in section, of the drill pipe spinner of the invention, in the open position.
Figure 2:
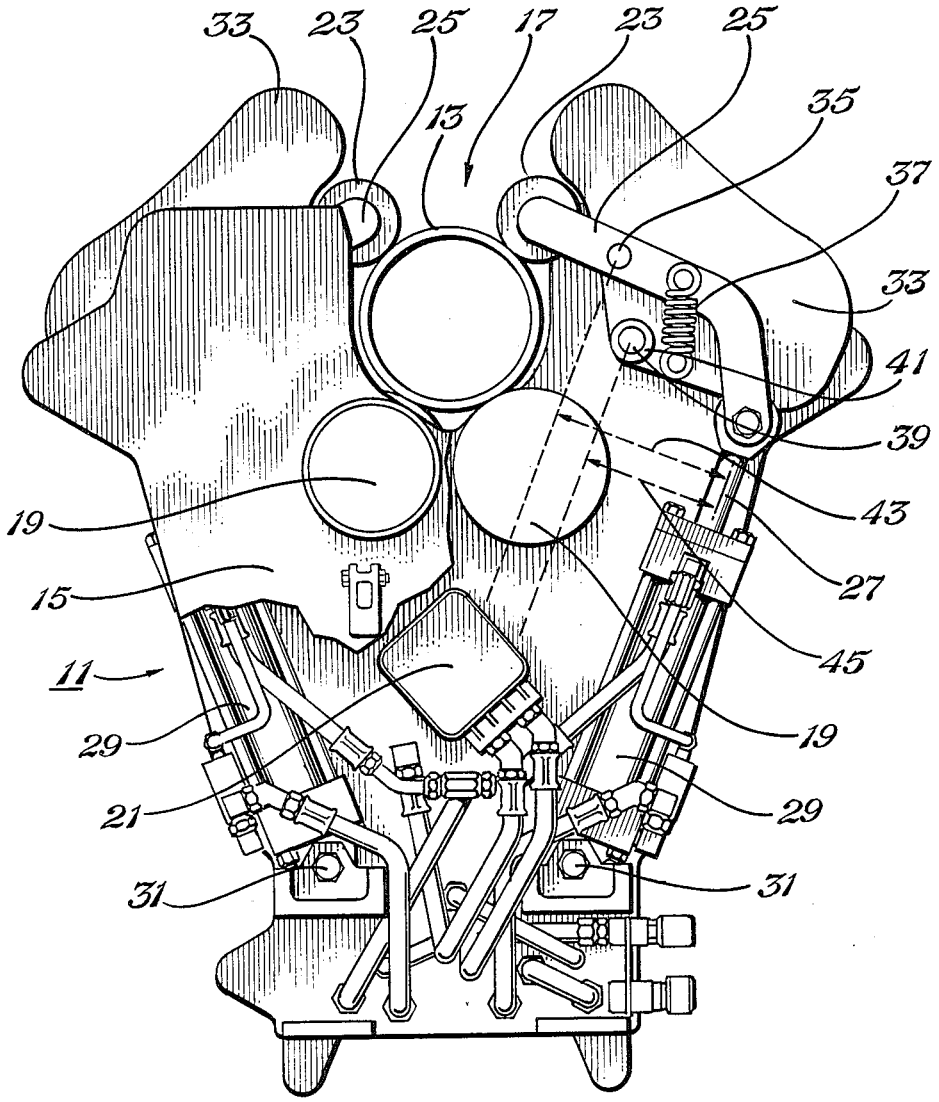
FIG. 2 is a top view, partially in section, of the drill pipe spinner of the invention, in the closed position.

The drill pipe spinner 11 of the invention is designed to spin a stand of drill pipe 13 into or out of connection with another stand of drill pipe (not shown). The body 15 of the spinner 11 has an open throat 17 large enough to handle any size drill pipe 13 from $2\frac{7}{8}$ inches to $9\frac{5}{8}$ inches.

A pair of aluminum driven rollers 19 are mounted on the body 15 of the spinner 11. These rollers 19 are cylindrical and are mounted for rotation about a vertical axis. The rollers 19 are driven by a hydraulic motor 21, which is also mounted on the body 15 of the spinner 11.

The spinner 11 also has a pair of aluminum pressure rollers 23. The pressure rollers 23 are also cylindrical and mounted for rotation about a vertical axis.

Each pressure roller 23 is mounted on one end of a secondary pressure arm 25. The other end of each secondary pressure arm 25 is connected to a piston rod 27, which is part of a hydraulic cylinder and piston assembly 29. The cylinder and piston assemblies 29 are pivotally connected to the body 15 of the spinner 11 at pivot pins 31.

Each secondary pressure arm 25 is mounted on one of two primary pressure arms 33. The secondary pressure arms 25 are pivotable, relative to the primary pressure arms 33, about secondary pivot pins 35. However, a spring 37 holds each pair of pressure arms 23, 33 against relative rotation.

Each primary pressure arm 33 is mounted on the body 15 of the spinner 11. The primary pressure arms 33 are rotatable about primary pivot pins 39.

A series of three sprag clutches 41 are stacked vertically around each pivot pin 39, to keep the primary pressure arms 33 from rotating backwards. A ratchet or a friction brake could be used in lieu of the sprag clutches 41.

In operation, the spinner begins in the open position, as shown in FIG. 1. The piston rods 27 are in the retracted position, and the pressure rollers 23 are away from the open throat 17 of the spinner 11. The primary pressure arms 33 are also pivoted away from the throat 17.

The spinner 11 is then moved onto the drill pipe 13. The drill pipe 13 is positioned within the open throat 17 of the spinner 11.

The hydraulic cylinder and piston assemblies 29 are then actuated to extend the piston rods 27. The piston rods 27 exert force on one end of the secondary pressure arms 25. The springs 37 cause the primary pressure arms 33 to rotate with the secondary pressure arms 25, so the pressure arms 25, 33 rotate about the primary pivot pins 39. The pressure arms 25, 33 will continue to rotate until the pressure rollers 23 contact the drill pipe 13.

Further force on the secondary pressure arms 25 by the piston rods 27 places a moment on the primary pressure arms 33 in the opposite direction, tending to cause the primary pressure arms 33 to rotate backwards. However, the sprag clutches 41 prevent back rotation of the primary pressure arms 33 about the primary pivot pins 39.

Since the primary pressure arms 33 can no longer rotate in either direction, the forces on the secondary pressure arms 25 now cause moments about the secondary pivot pin 35, rather than the primary pivot pins 39. The moment arms 43 between the piston rods 27 and secondary pivot pins 35 are longer than the moment arms 45 between the piston rods 27 and the primary pivot pins 39. Therefore, the forces of the pressure rollers 23 on the drill pipe 13 are multiplied by a larger factor. The pressure rollers 23 therefore hold the drill pipe 13 against the driven rollers 19 more effectively.

The hydraulic motor 21 is then actuated. The hydraulic motor 21 drives the driven rollers 19, to spin the drill pipe 13.

After the spinning operation, the sprag clutches 41 are released, and the piston rods 27 are retracted by the cylinder and piston assemblies 29. The reversed forces on the ends of the secondary pressure arms 25 cause the pressure arms 25, 33 to pivot away from the open throat 17. The spinner 11 can then be removed from the drill pipe 13.

The power drill pipe spinner of the invention has several advantages over the prior art. The invention increases the force of the pressure rollers 23 on the drill pipe 13, without adding appreciatively to the complexity of the spinner 11. The increased moment arms 43 allow an equivalent cylinder and piston assembly 29 to place a higher force on the drill pipe 13. The spinner 11 of the invention therefore provides such a positive clamping action, that the motor 21 will stall before the pressure rollers 23 begin to slip.

The invention has been shown in only one of its forms. It should be apparent to those skilled in the art that it is not so limited, but is susceptible to various changes and modifications without departing from the spirit thereof.

We claim:

1. A drill pipe spinner, comprising:

a body, having an open throat for receiving a drill pipe;

a cylindrical driven roller, mounted on the body, for rotation about a vertical axis;

a primary pressure arm, pivotally mounted on the body, for rotation relative to the body, about a primary pivot pin;

a secondary pressure arm, pivotally mounted on the primary pressure arm, for rotation relative to the primary pressure arm, about a secondary pivot pin;

a cylindrical pressure roller mounted on one end of the secondary pressure arm, for holding the drill pipe against the driven roller;

power means for exerting a force on the other end of the secondary pressure arm, to cause the secondary pressure arm to rotate;

means for causing the primary pressure arm to rotate with the secondary pressure arm, about the primary pivot pin, until the pressure roller has contacted the drill pipe; and means for preventing back rotation of the primary pressure arm, about the primary pivot pin.

2. A drill pipe spinner, comprising:

a body, having an open throat for receiving a drill pipe;

a cylindrical driven roller, mounted on the body, for rotation about a vertical axis;

a pressure arm, pivotally mounted on the body, for rotation relative to the body, about a primary pivot pin;

a secondary pressure arm, pivotally mounted on the primary pressure arm, for rotation relative to the primary pressure arm, about a secondary pivot pin;

a cylindrical pressure roller mounted on one end of the secondary pressure arm, for holding the drill pipe against the driven roller;

a piston and cylinder assembly, for exerting a force on the other end of the secondary pressure arm, to cause the secondary pressure arm to rotate;

a spring, mounted between the primary and secondary pressure arms, for causing the primary pressure arm to rotate with the secondary pressure arm, about the primary pivot pin, until the pressure roller has contacted the drill pipe; and means for preventing back rotation of the primary pressure arm, about the primary pivot pin.

3. A drill pipe spinner, comprising:

a body, having an open throat for receiving a drill pipe;

a cylindrical driven roller, mounted on the body, for rotation about a vertical axis;

a pressure arm, pivotally mounted on the body, for rotation relative to the body, about a primary pivot pin;

a secondary pressure arm, pivotally mounted on the primary pressure arm, for rotation relative to the primary pressure arm, about a secondary pivot pin;

a cylindrical pressure roller mounted on one end of the secondary pressure arm, for holding the drill pipe against the driven roller;

a piston and cylinder assembly, for exerting a force on the other end of the secondary pressure arm, to cause the secondary pressure arm to rotate;

a spring, mounted between the primary and secondary pressure arms, for causing the primary pressure arm to rotate with the secondary pressure arm, about the primary pivot pin, until the pressure roller has contacted the drill pipe; and a plurality of sprag clutches, for preventing back rotation of the primary pressure arm, about the primary pivot pin.

4. A drill pipe spinner, comprising:

a body, having an open throat for receiving a drill pipe;

A cylindrical driven roller, mounted on the body, for rotation about a vertical axis;

a pressure arm, pivotally mounted on the body, for rotation relative to the body, about a primary pivot pin;

a secondary pressure arm, pivotally mounted on the primary pressure arm, for rotation relative to the primary pressure arm, about a secondary pivot pin;

a cylindrical pressure roller mounted on one end of the secondary pressure arm, for holding the drill pipe against the driven roller;

power means for exerting a force on the other end of the secondary pressure arm, to cause the secondary pressure arm to rotate, the moment arm between the power means and the primary pivot pin being shorter than the moment arm between the power means and the secondary pivot pin;

means for causing the primary pressure arm to rotate with the secondary pressure arm, about the primary pivot pin, until the pressure roller has contacted the drill pipe; and means for preventing back rotation of the primary pressure arm, about the primary pivot pin.

5. A drill pipe spinner, comprising:

a body, havng an open throat for receiving a drill pipe;

a cylindrical driven roller, mounted on the body, for rotation about a vertical axis;

a pressure arm, pivotally mounted on the body, for rotation relative to the body, about a primary pivot pin;

a secondary pressure arm, pivotally mounted on the primary pressure arm, for rotation relative to the primary pressure arm, about a secondary pivot pin;

a cylindrical pressure roller mounted on one end of the secondary pressure arm, for holding the drill pipe against the driven roller;

a piston and cylinder assembly, for exerting a force on the other end of the secondary pressure arm, to cause the secondary pressure arm to rotate, the moment arm between the piston and cylinder assembly and the primary pivot pin being shorter than the moment arm between the piston and cylinder assembly and the secondary pivot pin;

a spring, mounted between the primary and secondary pressure arms, for causing the primary pressure arm to rotate with the secondary pressure arm, about the primary pivot pin, until the pressure roller has contacted the drill pipe; and means for preventing back rotation of the primary pressure arm, about the primary pivot pin.

6. A drill pipe spinner, comprising:

a body, having an open throat for receiving a drill pipe;

a cylindrical driven roller, mounted on the body, for rotation about a vertical axis;

a pressure arm, pivotally mounted on the body, for rotation relative to the body, about a primary pivot pin;

a secondary pressure arm, pivotally mounted on the primary pressure arm, for rotation relative to the primary pressure arm, about a secondary pivot pin;

a cylindrical pressure roller mounted on one end of the secondary pressure arm, for holding the drill pipe against the driven roller;

a piston and cylinder assembly, for exerting a force on the other end of the secondary pressure arm, to cause the secondary pressure arm to rotate, the moment arm between the piston and cylinder assembly and the primary pivot pin being shorter than the moment arm between the piston and cylinder assembly and the secondary pivot pin;

a spring, mounted between the primary and secondary pressure arms, for causing the primary pressure arm to rotate with the secondary pressure arm, about the primary pivot pin, until the pressure roller has contacted the drill pipe; and a plurality of sprag clutches, for preventing back rotation of the primary pressure arm about the primary pivot pin.

* * * * *